US007225510B2

(12) United States Patent
Gallant

(10) Patent No.: US 7,225,510 B2
(45) Date of Patent: Jun. 5, 2007

(54) FASTENER PRODUCT

(75) Inventor: Christopher M. Gallant, Nottingham, NH (US)

(73) Assignee: Velern Industries B.V., Caracas (NL)

( * ) Notice: Subject to any disclaimer, the term of this patent is extended or adjusted under 35 U.S.C. 154(b) by 0 days.

(21) Appl. No.: 10/382,178

(22) Filed: Mar. 5, 2003

(65) Prior Publication Data

US 2004/0172793 A1 Sep. 9, 2004

(51) Int. Cl.
*A44B 17/00* (2006.01)
*A44B 18/00* (2006.01)

(52) U.S. Cl. ..... 24/451; 24/452

(58) Field of Classification Search ..... 24/442, 24/306, 444–448, 451, 572.1, 580, 452; 604/391; 428/99, 100
See application file for complete search history.

(56) References Cited

U.S. PATENT DOCUMENTS

| | | | | |
|---|---|---|---|---|
| 3,214,816 A | | 11/1965 | Mathison | |
| 3,261,069 A | * | 7/1966 | Mathison | 24/450 |
| 3,312,583 A | | 4/1967 | Rochlis | |
| 3,426,363 A | | 2/1969 | Girard | |
| 3,762,000 A | * | 10/1973 | Menzin et al. | 24/452 |
| 3,840,945 A | * | 10/1974 | Brumlik | 24/451 |
| 3,879,635 A | * | 4/1975 | Brumlik | 29/412 |
| 3,889,322 A | | 6/1975 | Brumlik | |
| 3,899,803 A | * | 8/1975 | Brumlik | 24/444 |
| 3,913,183 A | * | 10/1975 | Brumlik | 24/447 |
| 4,001,366 A | | 1/1977 | Brumlik | |
| 4,794,028 A | | 12/1988 | Fischer | |
| 4,846,815 A | * | 7/1989 | Scripps | 604/391 |
| 4,984,339 A | | 1/1991 | Provost et al. | |
| 5,058,247 A | | 10/1991 | Thomas et al. | |
| 5,116,563 A | * | 5/1992 | Thomas et al. | 264/167 |
| 5,315,740 A | | 5/1994 | Provost | |
| 5,325,569 A | | 7/1994 | Goulait et al. | |
| 5,326,612 A | | 7/1994 | Goulait | |
| 5,339,499 A | | 8/1994 | Kennedy et al. | |
| 5,392,498 A | | 2/1995 | Goulait et al. | |
| 5,473,800 A | * | 12/1995 | Hatomoto et al. | 24/442 |
| 5,537,720 A | | 7/1996 | Takizawa et al. | |
| 5,604,963 A | | 2/1997 | Akeno | |
| 5,685,050 A | | 11/1997 | Murasaki | |
| 5,749,129 A | | 5/1998 | Murasaki et al. | |
| 5,755,016 A | | 5/1998 | Provost | |
| 5,781,969 A | * | 7/1998 | Akeno et al. | 24/452 |

(Continued)

FOREIGN PATENT DOCUMENTS

EP 619085 A1 * 10/1994

*Primary Examiner*—Robert J. Sandy
*Assistant Examiner*—Andre' L. Jackson
(74) *Attorney, Agent, or Firm*—Fish & Richardson P.C.

(57) ABSTRACT

A hook member is provided that is capable of engaging fibers. The hook member includes a stem extending upwardly from a sheet-form base to a distal end. The stem has leading and trailing edges that form an apex angle therebetween. A crook is integrally formed with and arches along a curved axis directly from the stem of the hook member to a tip. The crook has a width measured along a line tangent to the tip and perpendicular to a central axis that bisects the apex angle and intersects a plane substantially parallel to the sheet-form base that is less than about 20 percent of a height of the hook member measured along a line extending perpendicular to the base.

37 Claims, 6 Drawing Sheets

U.S. PATENT DOCUMENTS 5,785,784 A * 7/1998 Chesley et al. ..... 156/66
5,845,375 A 12/1998 Miller et al.
5,876,827 A * 3/1999 Fink et al. ..... 428/95
5,884,374 A * 3/1999 Clune ..... 24/446
5,887,320 A * 3/1999 Provost ..... 24/452
5,900,350 A 5/1999 Provost et al.
5,913,482 A * 6/1999 Akeno ..... 24/452
6,061,881 A * 5/2000 Takizawa et al. ..... 24/446
6,131,251 A 10/2000 Provost
6,163,939 A * 12/2000 Lacey et al. ..... 24/452
6,482,286 B1 * 11/2002 Harvey et al. ..... 156/244.27
6,544,245 B2 * 4/2003 Neeb et al. ..... 604/391
6,546,604 B2 * 4/2003 Galkiewicz et al. ..... 24/572.1
6,588,073 B1 * 7/2003 Zoromski et al. ..... 24/446
6,737,147 B2 * 5/2004 Kennedy et al. ..... 428/100
6,746,434 B2 * 6/2004 Johnson et al. ..... 604/385.01
6,884,157 B2 * 4/2005 Chesley et al. ..... 451/538
6,996,880 B2 * 2/2006 Kurtz et al. ..... 24/446
2002/0039636 A1 * 4/2002 Fink et al. ..... 428/85
2002/0125605 A1 * 9/2002 Lacey et al. ..... 264/167

* cited by examiner

FASTENER PRODUCT

TECHNICAL FIELD

This invention relates to touch fasteners, and more particularly to touch fasteners for engaging fibers.

BACKGROUND

This invention relates generally to touch fasteners, and specifically to touch fasteners for engaging fibers and to methods and apparatus for their manufacture.

There has been much development over the last thirty years in the field of hook-and-loop fasteners. Early touch fastener products of this type consisted of two mating tapes, each being knit or woven. One tape would include loops of filament woven into a base, and the other would include filaments woven to form loops and then cut to form hooks. In some cases free ends of drawn plastic filaments on the male tape would be melted to form protruding heads. This shape of fastener element is sometimes called a "mushroom", to distinguish it from "hook"-shaped elements with re-entrant crooks.

More recently, continuous molding of fastener elements extending from a common sheet-form resin base has resulted in less expensive and thinner male tapes. Significant improvements in this area include the development of continuous fastener tape molding using fixed mold cavities (see Fischer, U.S. Pat. No. 4,794,028), and the ability to provide loops on the back side of the male fastener tape as the fastener tape substrate and elements are being formed (see Kennedy et al., U.S. Pat. No. 5,260,015), thus creating a composite fastener tape capable of fastening to itself.

Much recent development has been directed at making smaller fastener elements in dense arrays for engaging low-loft non-wovens and inexpensive, lightweight knits for disposable garments and such. It is now common to mold look-shaped fastener elements as short as 0.015 inch, or smaller.

Generally, male fastener elements are designed to engage stable loops or fibers (i.e., loops or fiber sections extending between two fixed ends). As discussed below, there is a need or desire for a releasable fastener capable of engaging a fibrous substrate.

SUMMARY

In an aspect of the invention, a touch fastener has an array of hook members that are capable of engaging fibers. A hook member includes a stem that extends upwardly from a sheet-form base to a distal end. The stem has a leading edge and a trailing edge that form an apex angle therebetween. The hook member includes a crook that is integrally formed with and arches along a curved axis directly from the stem to a tip. The crook has a width measured along a line tangent to the tip and perpendicular to a central axis that bisects the apex angle and intersects a plane substantially parallel to the sheet-form base is less than about 20 percent of a height of the hook member measured along a line extending perpendicular to the base.

Certain implementations of this aspect of the invention have the stem integrally molded with the base.

In another aspect of the invention, a touch fastener product includes a substrate having at least two fibrous tufts. Each tuft has a plurality of fibers that extend to free distal ends where the fibers of one tuft at least partially overlap fibers of the other tuft. The fastener product also includes a hook member sized to engage fibers of the plurality of fibers. The hook member includes a stem portion extending upwardly from a base and a crook portion integrally formed with the stem. The hook member has a height measured perpendicular to the base at least about 50 percent of an average fiber height over an area unit.

Certain implementations of this aspect of the invention have one or more of the following features. The height of the hook member is about 67 percent of the height of the average fiber height. The crook has a width measured along a line tangent to a tip of the crook and perpendicular to a central axis that bisects an apex angle formed between a leading edge and a trailing edge of the stem that is less than about 20 percent of the height of the hook member measured along a line extending perpendicular to the base. The substrate is a carpet.

In another aspect of the invention, a touch fastener product includes a substrate having at least two fibrous tufts. Each tuft has a plurality of fibers that extend to free distal ends where fibers of one tuft at least partially overlap fibers of the other tuft. The fastener product also includes a hook member sized to engage fibers of the plurality of fibers. The hook member includes a stem portion extending upwardly from and integrally molded with a sheet-form base and a head portion that overhangs the base. The hook member has a height measured perpendicular to the base at least about 50 percent of an average fiber height over an area unit.

Certain implementations of this aspect of the invention have one or more of the following features. The height of the hook member is about 67 percent of the height of the average fiber height. The substrate is a carpet. The head portion is a crook that is integrally formed with and arching along a curved axis directly from the stem to a tip. The crook having a width measured along a line tangent to a tip of the crook and perpendicular to a central axis that bisects an apex angle formed between a leading edge and a trailing edge of the stem that is less than about 20 percent of the height of the hook member measured along a line extending perpendicular to the base. The head portion is a mushroom.

In another aspect of the invention, a method of forming releasable fastening with a tufted substrate is provided. The method includes providing a sheet-form base including a plurality of hook members having stem portions integrally molded with and extending therefrom, the hook members including head portions extending from distal ends of the stem portions that overhang a surface of the sheet-form base; providing the tufted substrate having adjacent tufted portions, each of the tufted portions including a plurality of fibers extending to a free distal end, the fibers overlapping fibers of an adjacent tufted portion; and engaging the overlapping fibers of the adjacent tufts with the overhanging head portions of the hook members.

Certain implementations of this aspect of the invention have one or more of the following features. The method includes continuously introducing molten resin to a gap defined adjacent a periphery of a rotating mold roll such that molten resin forms at least a part of the sheet-form base at the periphery of the mold roll and fills an array of fixed fastener element cavities defined in the rotating mold roll to form the stem portions; solidifying the resin; and stripping the resin from the periphery of the mold roll by pulling the solidified stems from their respective cavities. The head portions are crooks that are integrally formed with and arch along respective curved axes directly from the stem to a tip. The crooks have a width measured along a line tangent to the tip of each crook and perpendicular to a central axis that bisects an apex angle formed between a leading edge and a trailing edge of each of the stems that is less than about 20 percent of a height of the hook members measured along a line extending perpendicular to the base. The head portions are mushrooms.

In another aspect of the invention, a touch fastener is provided that includes a sheet-form base and at least three hook members including stem portions extending outwardly from and integrally with the sheet-form base. The at least three hook members also include head portions that overhang the base. Each of the at least three hook members have a leading edge and a trailing edge defining therebetween an apex angle and each of the hook members include a central axis bisecting the apex angle and intersecting a plane parallel to the base. Each of the central axes of the hook members and the plane parallel to the base form therebetween at least three different base angles with respect to a common base reference.

Certain implementations of this aspect of the invention have one or more of the following features. A width of the crook measured along a line tangent to the tip and perpendicular to the central axis less than about 20 percent of a height of the hook member measured along a line extending perpendicular to the base. The head portions are crooks that are integrally formed with and arch along respective curved axes directly from the stem to a tip. The head portions are mushrooms.

Certain implementations of the foregoing aspects of the invention have one or more of the following features. A height of the hook member is greater than about 0.15 inch (0.38 cm), for example, between 0.168 inch (0.43 cm) to 0.2 inch (0.51 cm). The hook member has a displacement volume (the displacement volume is the product of the width of the crook, a height of the crook and a thickness of the crook) less than $3\times10^{-6}$ cubic inches ($4.9\times10^{-5}$ cubic cm), for example, $2.2\times10^{-6}$ cubic inches ($3.53\times10^{-5}$ cubic cm). The hook member has parallel sides in an end view. The apex angle formed by the leading and trailing edges is less than about 20 degrees, for example, about 14 degrees. The central axis of the hook member intersects the plane parallel to the sheet-form base at an angle of between about 30 to 90 degrees. The angle of intersection of the central axis and the plane parallel to the sheet-form base is 90 degrees. The array of hook members includes at least some hook members having central axes that intersect the plane parallel to the sheet-form base at angles different than central axes of other of the hook members. The hook member is made of nylon. The hook member is made of polypropylene. A thickness of the hook member is 0.03 inch (0.08 cm) or less. Hook members are arranged in discrete regions along the substrate. Where hook members are arranged in discrete regions, the regions form rows and/or columns.

Certain implementations of aspects of the invention have one or more of the following advantages. Fasteners are provided that are capable of engaging overlapping or abutting fibers of a fibrous substrate that has fibers that extend to free distal ends. This includes a tufted substrate, such as a tufted carpet. The hook members can include crooks that are relatively narrow in width when compared to the height of the hook member for allowing penetration of the hook member into the tufted carpet and minimizing displacement of the fibers of the fibrous substrate to allow engagement with overlapping or abutting fibers of the substrate. The height of the hook member is arranged to penetrate into the tufted substrate, beyond the free distal ends of the fibers toward the base of the substrate to engage the overlapping fibers.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
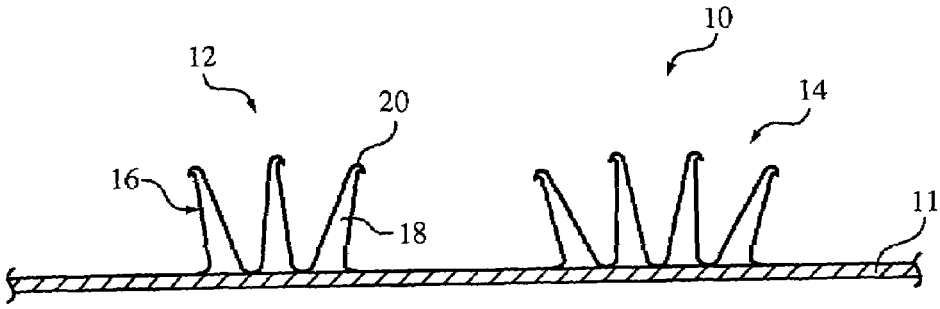
FIG. 1 is a longitudinal, cross-sectional view of a fastener component.

Referring to FIG. 1, a hook component 10 is shown having groups 12 and 14 of hook members. The hook component 10 includes a sheet-form base 11 and the hook members 16 extend from a surface of the base at an angle. Group member 14 has four hook members 16 and group 12 has three hook members 16, each of the hook members, as shown, include stem portions 18 and crook portions 20.

Hook component 10, including the hook members, can be advantageously formed using the Fischer process, U.S. Pat. No. 4,794,028, fully incorporated herein by reference, in which the mold cavities for molding the groups of hook members are formed in the peripheries of corresponding disk-form mold plates, the plates being stacked alternately with spacer plates that form the flat sides of the hook members. Use of the spacer plates can control hook component thickness t. The thickness, t, of hook components can be less than 0.03 inch (0.08 cm), including 0.02 inch (0.05 cm) or less.

Figure 2:
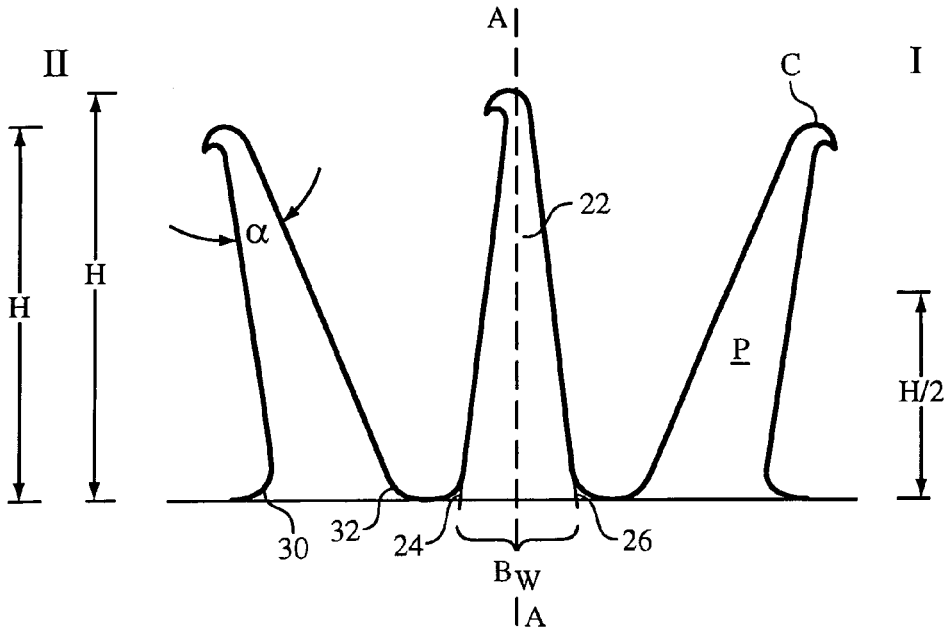
FIG. 2 is a profile view of a group of hook cavities.
Figure 3:
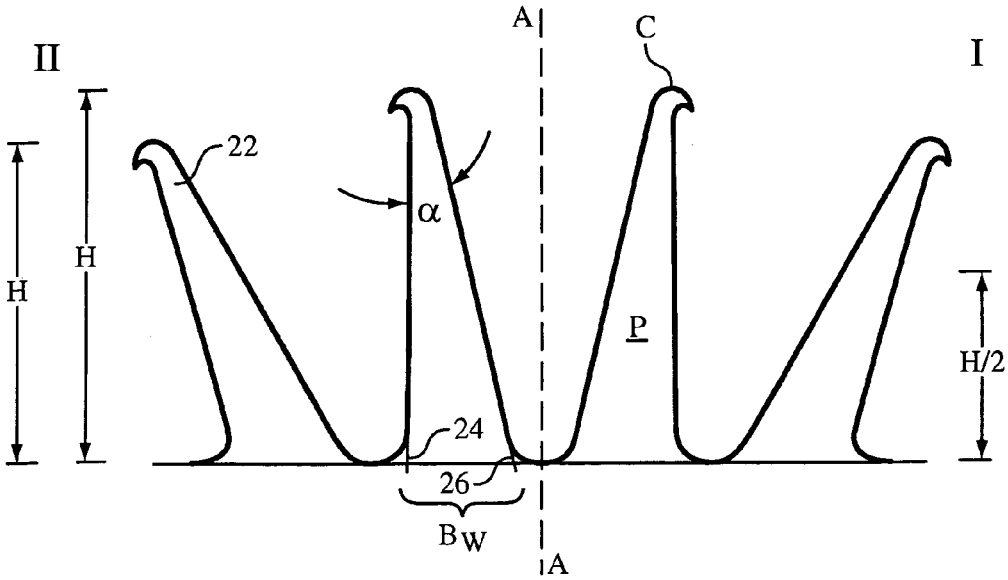
FIG. 3 is a profile view of a group of hook cavities.

Referring to FIGS. 2 and 3, the profile of a grouping of mold cavities 22 is shown. As a reference, axis AA extends perpendicular to a base surface through the center of the hook groupings 12, 14 forming quadrants I and II. The groupings preferably contain three or four mold cavities, but can contain less or more cavities within each grouping, for example, 2 to 10 cavities. Each cavity 22 defines a stem portion or chamber P and can include a crook portion or chamber C. Stem portion P has the profile of a triangle, with relatively straight sides projected to intersect at apex $\alpha$, at the vicinity of the top of the mold cavity. Each mold cavity 22 also has a total height H, measured along a line perpendicular to a base surface. In a variation, cavities can define only stem portions P without crook portions C. However, for simplicity, embodiments described below refer to stem portions as well as crook portions.

Each mold cavity profile has a base width $B_w$, measured between intersections of projections 24 and 26 of the sides of the mold cavities with the base surface 28 of the mold, that is less than about 35 percent the height H of the hook element. As shown, $B_w$ is about 25 percent of the height H.

Each cavity has an apex angle $\alpha$ of less than about 20 degrees and preferably about 14 degrees, the stem portion P continuously tapers from the base (ignoring fillets 30 and 32) to a point above the half height H/2. The inside surface of the mold cavity 22 then begins to curve to define the lower surface of the crook portion C, while the back surface of the mold cavity profile proceeds straight for a further distance. The crook portion of the mold cavity tapers continually to its tip. In the profile of FIGS. 2 and 3, the crook portion continues until its tip portion, directed downwardly, reaches the level of the top of the stem portion, but can extend to a level less than or more than the top of the stem portion.

Figure 4:
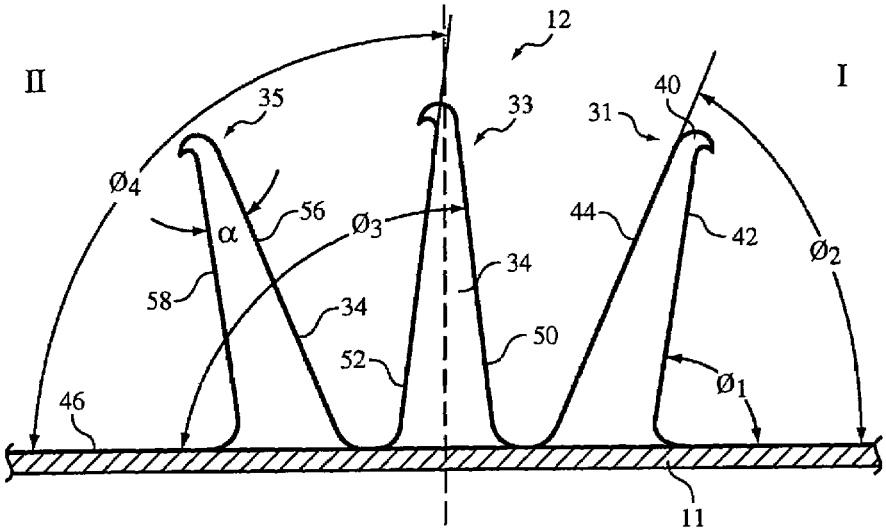
FIG. 4 is a longitudinal side view of a hook component section featuring three hook members.
Figure 5:
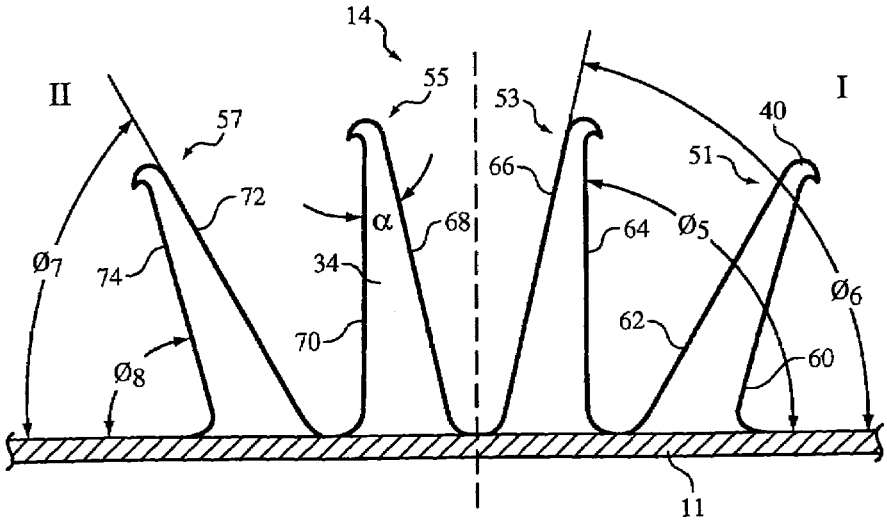
FIG. 5 is a longitudinal side view of a hook component section featuring four hook members.
Figure 5A:
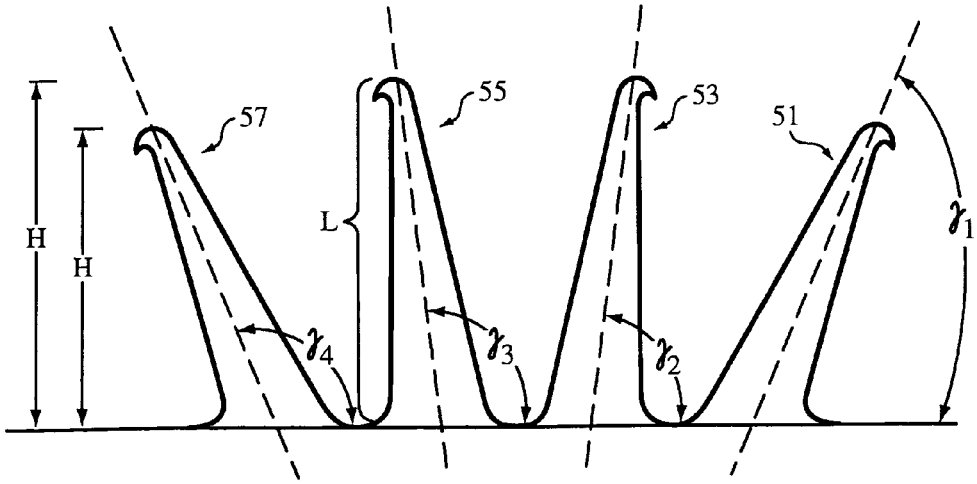
FIG. 5*a* is a longitudinal side view of a hook component section featuring four hook members.

Referring now to FIGS. 4–5*a*, sectional views of hook components of a touch fastener are shown. The hook components include a sheet-form base 11 and groups 12, 14 of hook members having stem portions that extend from a surface of the base sheet.

A tapered stem 34 of each of the hook members of the group 12, 14 is integrally formed with and extends upwardly from the sheet-form base 11. Preferably, the stems 34 have straight sides and, in some embodiments, at least one hook member in a group has a stem portion that extends upwardly forming a pyramidal shape having a base plane parallel to a plane defined by the sheet-form base when viewed in a side profile (see hook member 33 of FIG. 4). The hook members in the groups have tapered crook portions 40 that are integrally molded with the stems 34. The crook portions 40 arch along respective curved axes directly from the top of the stem to a tip. The crook portion 40 is adapted to engage overlapping fibers of a fibrous substrate.

Figure 4A:
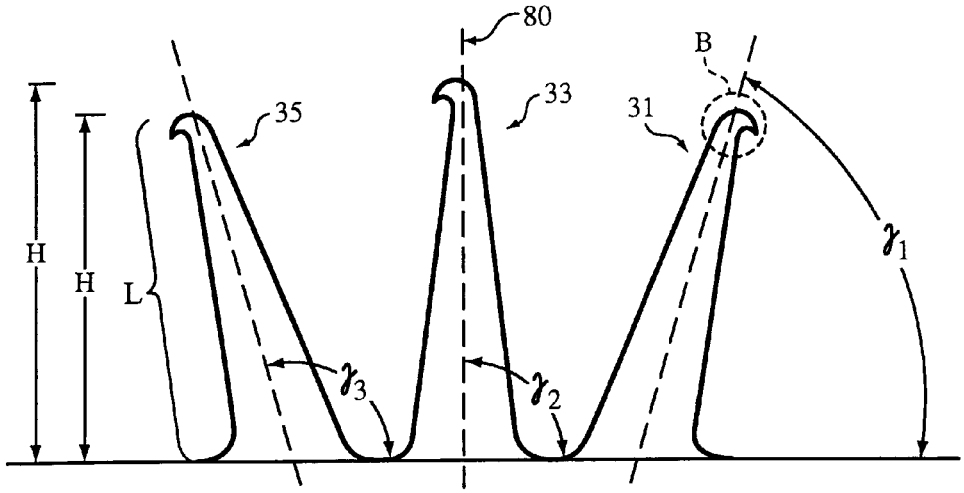
FIG. 4*a* is a longitudinal side view of a hook component section featuring three hook members.

Referring to FIGS. 4 and 4*a*, a grouping of three hook members is shown. The leading and trailing edges intersect a surface of the sheet-form base at angles $\theta$. Referring particularly to FIG. 4, stem 34 of hook member 31 includes relatively straight sides. Side 42, the leading edge, intersects the base surface at an angle $\theta_1$ about 82 degrees (preferably between about 77 to 87 degrees). A trailing edge 44, opposite the leading edge, intersects the base surface 46 at an angle $\theta_2$ about 68 degrees (preferably between about 63 to 73 degrees). Stem 34 of hook member 33 has a leading edge 50 that intersects the base surface 46 at an angle $\theta_3$ about 83 degrees (preferably between about 78 to 88 degrees). A trailing edge 52, opposite the leading edge, intersects the base surface 46 at an angle $\theta_4$ of about 97 degrees (preferably between about 92 to 102 degrees). Measured from the base surface of quadrant II, stem 34 of hook member 35 has a leading edge 56 that intersects the base surface 46 at an angle (not shown) about 68 degrees (preferably between about 63 to 73 degrees). A trailing edge 58, opposite the leading edge, intersects the base surface at an angle (not shown) of about 82 degrees (preferably between about 77 to 87 degrees).

Referring to FIGS. 5 and 5*a*, a grouping of four hook cavities is shown. Referring to FIG. 5, stem 34 of hook member 51, as noted above, includes relatively straight sides. Side 60, the leading edge, intersects the base surface 46 at an angle (not shown; measured from the base surface of quadrant I) of about 74 degrees (preferably between about 69 to 79 degrees). The trailing edge 62, opposite the leading edge, intersects the base surface 46 at an angle (not shown; measured from the base of quadrant I) of about 61 degrees (preferably between about 56 to 66 degrees). Stem 34 of hook member 53 has a leading edge 64 that intersects the base surface 46 at an angle $\theta_5$ of about 89 degrees (preferably between about 84 to 94 degrees). The trailing edge 66, opposite the leading edge, intersects the base surface 46 at an angle $\theta_6$ of about 76 degrees (preferably 71 to 81 degrees). Similarly, stem 34 of hook member 55 has a leading edge 68 that intersects the base surface 46 at an angle (not shown; measured from the base surface of quadrant II) of about 89 degrees (preferably between about 84 to 94 degrees). The trailing edge 70, opposite the leading edge, intersects the base surface 46 at an angle of about 76 degrees (preferably between about 71 to 81 degrees). Stem 34 of hook member 57 has a leading edge 72 that intersects the base surface at an angle $\theta_7$ of about 74 degrees (preferably between about 69 to 79 degrees). The trailing edge 74, opposite the leading edge, intersects the base surface 46 at an angle $\theta_8$ of about 61 degrees (preferably between about 56 to 66 degrees).

Referring now to FIGS. 4–5*a*, when the leading edges and the trailing edges of the hook member profiles are projected, they intersect at an angle $\alpha$ that is preferably less than about 20 degrees. Referring to FIGS. 4 and 5, $\alpha$ is about 14 degrees. While angle $\alpha$ is equal for each of the hook members illustrated by FIGS. 4 and 5, the angles $\alpha$ can vary.

Referring now to FIGS. 4*a* and 5*a*, central axes 80 of each hook member intersect the base 46 at an angle $\gamma$. The central axis bisects the angle $\alpha$. In FIG. 4*a*, measured from the surface of the sheet-form base of quadrant I (indicating a common base reference), $\gamma_1$ is less than $\gamma_2$ and $\gamma_2$ is less than $\gamma_3$. In the example of FIG. 4*a*, $\gamma_1$ is about 75 degrees (preferably between about 65 to 85 degrees), $\gamma_2$ is about 90 degrees (preferably between about 80 to 100 degrees) and $\gamma_3$ about 105 degrees (preferably about 95 to 115 degrees). Referring now to FIG. 5*a*, measuring from the surface of the sheet-form base of quadrant I, $\gamma_1$ is about 68 degrees (preferably between about 58 to 78 degrees), $\gamma_2$ is about 82 degrees (preferably between about 72 to 92 degrees), $\gamma_3$ is about 98 degrees (preferably between about 88 to 108 degrees) and $\gamma_4$ is about 112 degrees preferably between about 102 to 122 degrees).

The length L of each hook member is measured along the central axis 80 from the base of the hook to the highest point of intersection. The length of the hook members is preferably at least 0.15 inch, for example, about 0.2 inch (0.51 cm). However, the length of the hook depends, at least in part, on the application, which will be discussed in greater detail below.

Forming the hook members with broad bases and slanting leading and trailing edges allows the hook members to be removed more easily from the mold cavities because the crook portion can pass more easily through the portion of the mold cavity in which the stem was formed, i.e., through the stem chamber. Furthermore, due to the stem base width, each hook member is able to withstand relatively high shear loads despite the relative thinness of the hook member. However, because the hook members are used to mate with fibers having free standing ends, e.g., a tufted carpet, the bases of the stems must be narrow enough to allow penetration of the fastener component through the tufts to engage overlapping fibers, which will also be discussed in greater detail below.

For use in applications for the new hook component in conjunction with free standing fibers of, for example, a tufted substrate, such as a tufted carpet, the hook members are relatively tall, about 0.2 inch, as an example. The height H of the hook members is preferably greater than about 0.15 inch. Referring to FIG. 4*a*, the height of hook member 31 is about 0.181 inch (0.46 cm), the height of hook member 33 is about 0.2 inch (0.51 cm) and the height of hook member 35 is about 0.181 inch (0.46 cm). Referring now to FIG. 5*a*, the height of hook member 51 is about 0.168 inch (0.43 cm), the height of hook member 53 is about 0.192 inch (0.49 cm), the height of hook member 55 is about 0.192 inch (0.49 cm), and the height of hook member 57 is about 0.168 inch (0.43 cm).

Figure 4B:
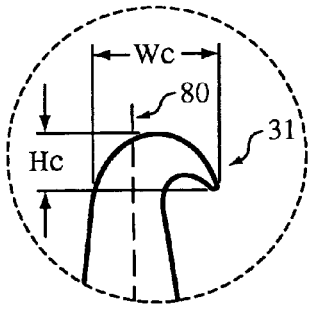
FIG. 4*b* is a detail view along line B of FIG. 4*a*.

The width $W_c$ of the crook portions is relatively short compared to the height of the hook members (see FIG. 4*b*). The width of the crook is measured along a line extending tangent to the tip of the crook and perpendicular to the central axis 80 of the hook member to the far edge of the hook member. The width $W_c$ of each of the hook members shown is preferably less than about 20 percent of the height of the hook members. For each of the hook members within a group, because they extend at various central angles γ from the base, the percentage varies with each hook member within the group. As shown in FIG. 4*a*, hook member 31 has a crook width $W_c$ of about 7.8 percent of the height of the hook member, hook member 33 has a crook width of about 7 percent of the height of the hook member and hook member 35 has a crook width of about 7.8 percent of the height of the hook member.

Referring now to FIG. 5*a*, hook member 51 has a crook width of about 8.3 percent of the height of the hook member, hook member 53 has a crook width of about 7.3 percent of the height of the hook member, hook member 55 has a crook width of about 7.3 percent of the height of the hook member and hook member 57 has a crook width of about 8.3 percent of the height of the hook member.

Figure 6:
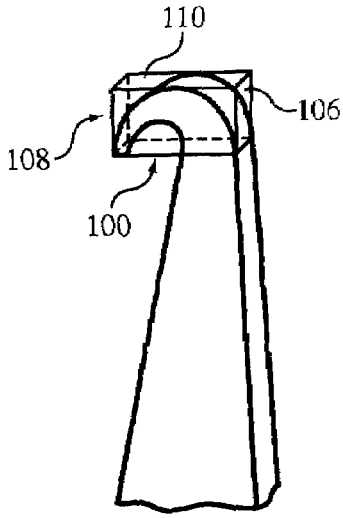
FIG. 6 is an enlarged, side view of a portion of a hook component.

Referring to FIG. 6, hook members have a displacement volume defined by a parallelepiped having a bottom plane 100, first and second side planes 102, 104, respectively, first and second end planes 106, 108, respectively, and a top plane 110. For simplicity, a hook member 112 having a central axis 80 having a γ of 90 degrees is shown. The bottom plane 100 is oriented perpendicular to the central axis 80 and tangent to the tip. The top plane 110 is perpendicular to the central axis 80 and tangent to the top of the hook member at the point where the hook member achieves its maximum distance from the base. The side planes 102, 104 lie in the planes of the sides of the hook member. The first end plane 106 is perpendicular to the bottom plane at the point where the bottom plane intersects the hook member at its trailing edge. The second end plane 108 is perpendicular to the bottom plane and tangent to the outermost portion of the crook. The mold cavity has a crook height $H_c$, a crook width $W_c$ and a thickness "t". The displacement volume DV of the crook portion of the hook member formed in the mold cavity is the product of $W_c$, Hc and "t". The hook member preferably has a displacement volume of less than about $3\times10^{-6}$ cubic inches ($4.9\times10^{-5}$ cubic cm).

Figure 7:
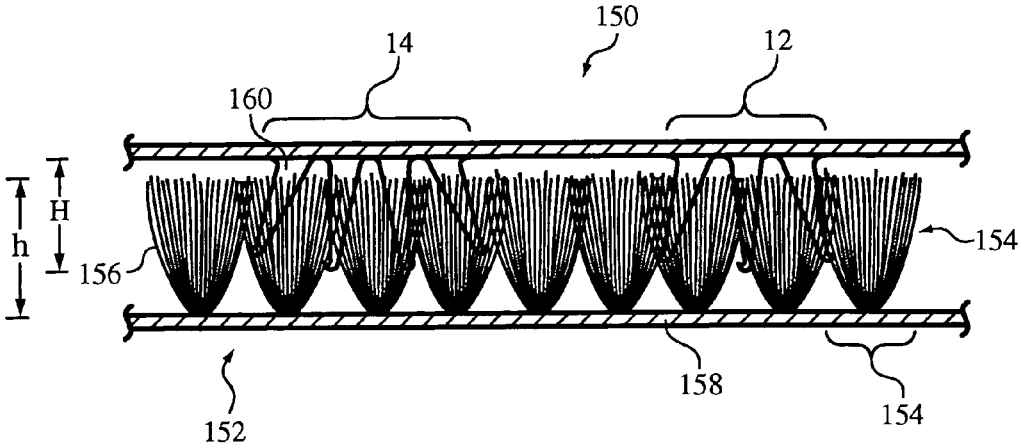
FIG. 7 is a side, cross-sectional view of a hook component engaged with a tufted substrate.

When used in certain applications, such as to engage a tufted substrate, for example, at least some of the hook members should be sized to penetrate fibers of the tufts to engage overlapping fibers. Referring to FIG. 7, a fastener component 150 is shown mating with overlapping fibers of a substrate 152. The substrate 150 includes multiple tufts 154, each tuft having multiple fibers 156. The fibers 156, at one end, are free and, at the other end, are bonded or attached to a base 158 of the substrate 152 by, for example, stitching, adhesive, or the like to form individual tufts 154. At the base of the substrate, the fibers 156 are attached or bonded in a relatively compact or dense configuration. Because of this densely pact arrangement, fibers 156 tend to extend radially outward. Due to this radial extension, fibers 156 become overlapped with fibers 156 of adjacent tufts 154.

The hook members 160, to engage these overlapped or abutting fibers, should be of sufficient height H to penetrate through the fibers beyond fiber overlap and/or abutment. Accomplishing this depends, in part, on the height of the fibers h, the fiber density of the tufts 154 and the tuft density of the substrate 152. It has been recognized that a hook member height H of preferably at least 50 percent of the average fiber height h and preferably a hook member height of about 67 percent of an average fiber height, can accomplish sufficient penetration depth. The average fiber height per unit area of substrate can be determined by, for example, vernier caliper.

Another factor for sufficient hook penetration is the crook portion width $W_c$. A wide crook width makes penetration more difficult. Additionally, the displacement volume of the crook member can also affect mating. A large displacement volume can disentangle overlapping or abutting fibers to make mating more difficult and less probable. Other factors affect hook member penetration and mating such as stem width, density of hook members per unit area of base and fiber density of the tufted substrate. At least some of these factors can be controlled by arrangement of the hook member groups along the base of the hook component (which will be discussed in greater detail below).

Figure 9A:
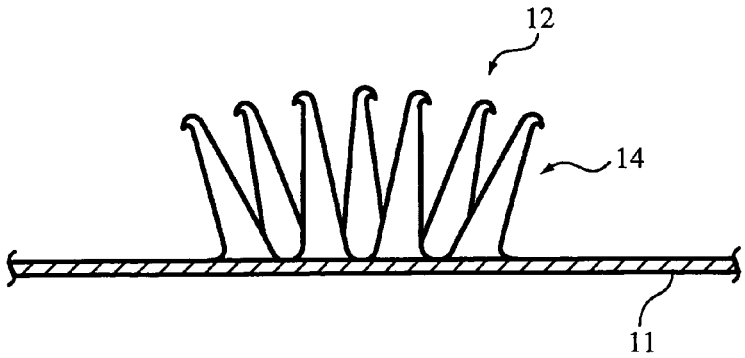
FIG. 9*a* is a side view of a section of the hook component of FIG. 9 along line AA.
Figure 8:
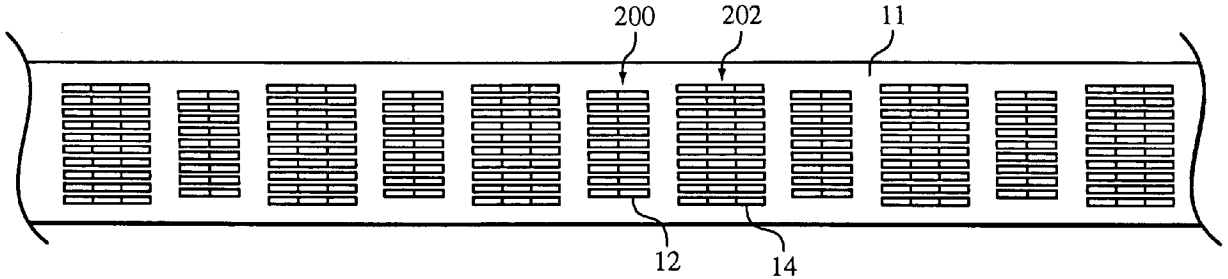
FIG. 8 is a top view of a hook component.
Figure 9:
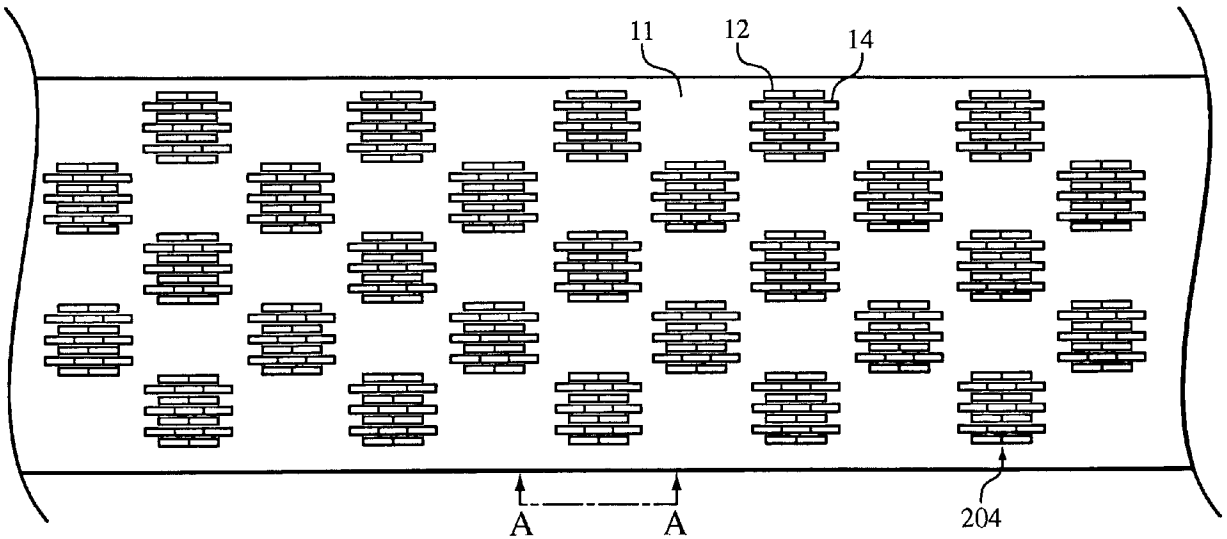
FIG. 9 is a top view of another hook component.

Referring now to FIGS. 8 and 9, hook components are shown having hook member groups that are arranged along the sheet-form base 11 in patterns, such as in FIG. 8, showing parallel rows 200, 202 of hook member groups 12 and 14. Row 200 has hook member groups 12 having three hook members as described above with respect to FIG. 4 and row 202 has hook member groups 14 having four hook members as described above with respect to FIG. 5. The rows can contain any arrangement of hook member groups 12, 14 within rows. For example, referring to FIG. 10, a row of hook member groups is shown alternating between a hook member group 12 of three hook members and a hook member group 14 of four hook members. The size and arrangement of the hook members and hook member groups within the row can be chosen to align the hook members in various advantageous arrangements to maximize mating potential (see FIGS. 9 and 9*a*).

Referring to FIG. 9, another hook component arrangement includes alternating hook patches 204 and hook-free patches forming a checkerboard-like arrangement. As above, the hook member groups within each hook patch can be arranged in various configurations such as alternating between the number of hook members within each group or having a consistent number of hook members within each group.

An alternative hook component arrangement includes an array of hook members having stem portions that extend from the sheet form base at substantially the same angle γ, such as about 90 degrees, as an example. The hook elements can be relatively evenly spaced, or can be arranged in patches, rows, or the like, as in FIGS. 8 and 9, above.

While embodiments described above included crook portions, only stem portions can be formed to extend from a surface of a base, as described above. Distal ends of the molded stem portions can be later deformed to form head portions that overhang the surface of the sheet-form base. Head portions can be formed by, for example, heating the distal ends by, such as, a non-contact heating process, to deform the ends, or the heated ends can be brought into contact with a topping roller to form mushroom or flat-topped heads. Suitable non-contact heat sources can include flame heaters, electrically heated nichrome wire, and radiant heater blocks. Suitable methods for deforming molded stems are found in U.S. Pat. No. 6,248,276 and U.S. Pat. No. 5,077,870, the entire contents of which are incorporated herein by reference. All of the distal ends can be post-formed or less than all of the distal ends can be post-formed to form a hook component having both stems without and with head portions. Molded components can include, for example nylon, polypropylene, or the like.

A number of embodiments of the invention have been described. Nevertheless, it will be understood that various modifications may be made without departing from the spirit and scope of the invention.

What is claimed is:

1. A touch fastener comprising:

a sheet-form base; and a plurality of hook member groupings comprising at least three hook members, each of the hook members comprising a stem portion extending outwardly from and integrally with the sheet-form base; and a crook integrally formed with and arching along a curved axis from the stem to a tip;

adjacent hook member groupings being separated by regions of the sheet-form base that are substantially free of hook members, each of the regions spanning a distance that is greater than a distance between adjacent hook members of the hook member groupings, wherein each of the hook members has a leading edge and a trailing edge defining therebetween an apex angle and includes a central axis bisecting the apex angle and intersecting a plane parallel to the sheet-form base, the central axes of the hook members and the plane parallel to the sheet-form base forming therebetween at least three different base angles with respect to a common base reference, and each of the central axes of the hook members residing in a common plane.

2. The touch fastener of claim 1, wherein the common plane extends substantially perpendicular to the sheet-form base.

3. The touch fastener of claim 1, wherein the crook has a width, measured along a line tangent to the tip and perpendicular to the central axis, that is less than about 20 percent of a height of the hook member measured along a line extending perpendicular to the base.

4. The touch fastener of claim 1, wherein the hook member groupings are longitudinally spaced apart about the sheet-form base.

5. The touch fastener of claim 1, wherein the hook member groupings are arranged in substantially parallel rows about the sheet-form base.

6. The touch fastener of claim 1, wherein portions of the substrate between at least some of the hook member groupings are free of hook members.

7. The touch fastener of claim 1, wherein the common plane extends substantially perpendicular to the base.

8. A touch fastener comprising:

a sheet-form base; and a hook member grouping arranged in a discrete region of the sheet-form base, the hook member grouping comprising at least three hook members including stem portions extending outwardly from and integrally with the sheet-form base and head portions that overhang the base, each of the hook members having a leading edge and a trailing edge defining therebetween an apex angle;

wherein each of the hook members includes a central axis bisecting the apex angle and intersecting a plane parallel to the base, the central axes of the hook members and the plane parallel to the base forming therebetween at least three different base angles with respect to a common base reference, and each of the central axes of the hook members residing in a common plane, wherein the hook member grouping is adjacent a region of the sheet-form base that is substantially free of hook members, the region spanning a distance that is greater than a distance between adjacent hook members of the hook member grouping.

9. The touch fastener of claim 8, wherein the at least three hook members have a height measured along a line extending perpendicular to the base greater than 0.15 inch.

10. The touch fastener of claim 8, wherein a width of the crook measured along a line tangent to the tip and perpendicular to the central axis is less than about 20 percent of the height of the hook member measured along a line extending perpendicular to the base.

11. The touch fastener of claim 8, wherein each of the head portions form a crook that is integrally formed with and arching along a curved axis directly from the stem to a tip.

12. The touch fastener of claim 8, wherein each of the head portions is a mushroom.

13. The touch fastener of claim 8, wherein the common plane extends substantially perpendicular to the base.

14. For a touch fastener having an array of hook members, a hook member capable of engaging fibers, the hook member comprising:

a stem extending upwardly from a sheet-form base to a distal end, the stem having a leading edge and a trailing edge that form an apex angle therebetween; and a crook integrally formed with and arching along a curved axis directly from the stem to a tip;

wherein the crook has a width measured along a line tangent to the tip and perpendicular to a central axis that bisects the apex angle and intersects a plane substantially parallel to the sheet-form base that is less than about 20 percent of a height of the hook member measured along a line extending perpendicular to the base.

15. The touch fastener of claim 14, wherein the height of the hook member is greater than about 0.15 inch.

16. The touch fastener of claim 14, wherein a displacement volume of the crook is $3\times10^{-6}$ cubic inches or less.

17. The touch fastener of claim 14, wherein the central axis of the hook member intersects the plane parallel to the sheet-form base at an angle between about 30 to 90 degrees.

18. The touch fastener of claim 17, wherein the angle of intersection is about 90 degrees.

19. The touch fastener claim 14, wherein the apex angle is less than about 20 degrees.

20. The touch fastener of claim 14, wherein the hook member has parallel sides in an end view.

21. The touch fastener of claim 14, wherein the stem is integrally molded with the sheet-form base.

22. The touch fastener of claim 14, wherein the hook member comprises nylon.

23. The touch fastener of claim 14, wherein the hook member comprises polypropylene.

24. The touch fastener of claim 14, wherein the hook member has a thickness of about 0.03 inch or less.

25. The touch fastener of claim 14, wherein the array of hook members includes at least some hook members having central axes that intersect the plane parallel to the sheet-form base at angles different than central axes of other of the hook members.

26. The touch fastener product of claim 14, wherein the array of hook members are arranged in discrete regions along the substrate.

27. The touch fastener product of claim 26, wherein the regions are parallel rows.

28. The touch fastener of claim 26, wherein the regions form a checkerboard-like pattern.

29. A touch fastener product comprising:

a substrate having at least two fibrous tufts, each tuft including a plurality of fibers extending to free distal fiber ends, the fibers of one tuft at least partially overlapped with the fibers of the other tuft; and a hook member sized to engage fibers of the plurality of fibers, the hook member including a stem portion extending upwardly from and integrally molded with a sheet-form base and a head portion that overhangs the bade, the hook member having a height measured perpendicular to the base at least about 50 percent of an average fiber height over an area unit.

30. The touch fastener product of claim 29, wherein the head portion is a crook that is integrally formed with and arching along a curved axis directly from the stem to a tip.

31. The touch fastener product of claim 29, wherein the head portion is a mushroom.

32. The touch fastener product of claim 29, wherein the hook member height is about 67 percent of the average fiber height over the area unit.

33. The touch fastener product of claim 29, wherein the crook having a width measured along a line tangent to a tip of the crook and perpendicular to a central axis that bisects an apex angle formed between a leading edge and a trailing edge of the stem that is less than about 20 percent of the height of the hook member.

34. A touch fastener product comprising:

a substrate having at least two fibrous tufts, each tuft including a plurality of fibers extending to free distal fiber ends, the fibers of one tuft at least partially overlapped with the fibers of the other tuft; and a hook member sized to engage fibers of the plurality of fibers, the hook member including a stem portion extending upwardly from a base and a crook portion integrally formed with the stem, the hook member having a height measured perpendicular to the base at least about 50 percent of an average fiber height.

35. The touch fastener product of claim 34, wherein the height of the hook member is about 67 percent of the height of the average fiber height.

36. The touch fastener product of claim 34, wherein the substrate is a carpet.

37. The touch fastener of claim 34, wherein the crook having a width measured along a line tangent to a tip of the crook and perpendicular to a central axis that bisects an apex angle formed between a leading edge and a trailing edge of the stem that is less than about 20 percent of the height of the hook member.

* * * * *

UNITED STATES PATENT AND TRADEMARK OFFICE

CERTIFICATE OF CORRECTION

PATENT NO. : 7,225,510 B2
APPLICATION NO. : 10/382178
DATED : June 5, 2007
INVENTOR(S) : Christopher M. Gallant It is certified that error appears in the above-identified patent and that said Letters Patent is hereby corrected as shown below:

Title Page

Item (73) Assignee: "Velern Industries B.V., Caracas" should be --Velcro Industries B.V., Curacao--

Signed and Sealed this

Fifth Day of August, 2008

JON W. DUDAS
*Director of the United States Patent and Trademark Office*

UNITED STATES PATENT AND TRADEMARK OFFICE

CERTIFICATE OF CORRECTION

PATENT NO. : 7,225,510 B2
APPLICATION NO. : 10/382178
DATED : June 5, 2007
INVENTOR(S) : Christopher M. Gallant It is certified that error appears in the above-identified patent and that said Letters Patent is hereby corrected as shown below:

On the Title Page Item -56-, line 7:
delete "3,879,635" and replace with --3,879,835--.

Claim 19, column 10, line 56:
delete "fastener claim" and replace with --fastener of claim--.

Claim 29, column 11, line 22:
delete "bade" and replace with --base--.

Signed and Sealed this

Twenty-fourth Day of February, 2009

JOHN DOLL
*Acting Director of the United States Patent and Trademark Office*